US008997762B2

(12) United States Patent
Pei

(10) Patent No.: US 8,997,762 B2
(45) Date of Patent: Apr. 7, 2015

(54) AUTOMATIC WAX REMOVING DEVICE AND AUTOMATIC WAX REMOVING METHOD USING SAME

(75) Inventor: Shao-Kai Pei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 268 days.

(21) Appl. No.: 13/490,463

(22) Filed: Jun. 7, 2012

(65) Prior Publication Data

US 2013/0139857 A1 Jun. 6, 2013

(30) Foreign Application Priority Data

Dec. 1, 2011 (TW) ..... 100144195 A

(51) Int. Cl.
*B08B 7/00* (2006.01)
*B24B 13/005* (2006.01)

(52) U.S. Cl.
CPC ..... *B24B 13/0057* (2013.01)

(58) Field of Classification Search
None
See application file for complete search history.

(56) References Cited

U.S. PATENT DOCUMENTS 3,183,637 A * 5/1965 Francis ..... 451/42
4,165,584 A * 8/1979 Scherrer ..... 451/289

* cited by examiner

*Primary Examiner* — Nicole Blan
(74) *Attorney, Agent, or Firm* — Novak Druce Connolly Bove + Quigg LLP

(57) ABSTRACT

An automatic wax removing device includes a base, a heating plate, a cooling plate, a first actuator, a second actuator, and an operation plate. The base includes a base plate and a framework. The heating plate is arranged on the base plate. The cooling plate is arranged on the base plate and separated from the heating plate. The first actuator includes a sliding rail and a elongated sliding member on the sliding rail. The sliding rail is fixed on the frame and parallel with the heating plate. The second actuator includes a main body and a rotation shaft arranged on the main body. The main body is slideable along the length of the sliding member. One end of the rotation shaft is connected to the main body. The operation plate is fixed to the other end of the rotation shaft.

11 Claims, 4 Drawing Sheets

AUTOMATIC WAX REMOVING DEVICE AND AUTOMATIC WAX REMOVING METHOD USING SAME

BACKGROUND

1. Technical Field

The present disclosure generally relates to an automatic wax removing device and an automatic wax removing method using the automatic wax removing device.

2. Description of Related Art

A method for removing wax from lenses for example includes a step of fully immersing the waxed lenses for 5 minutes to 20 minutes at a temperature in a range from 60 centigrade degrees to 80 centigrade degrees. In the step of the above process, pungent and harmful gas will be released.

What is needed, therefore, is an automatic wax removing device and an automatic max removing method to overcome the above-described problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Embodiments will be described with reference to the drawings.

Figure 1:
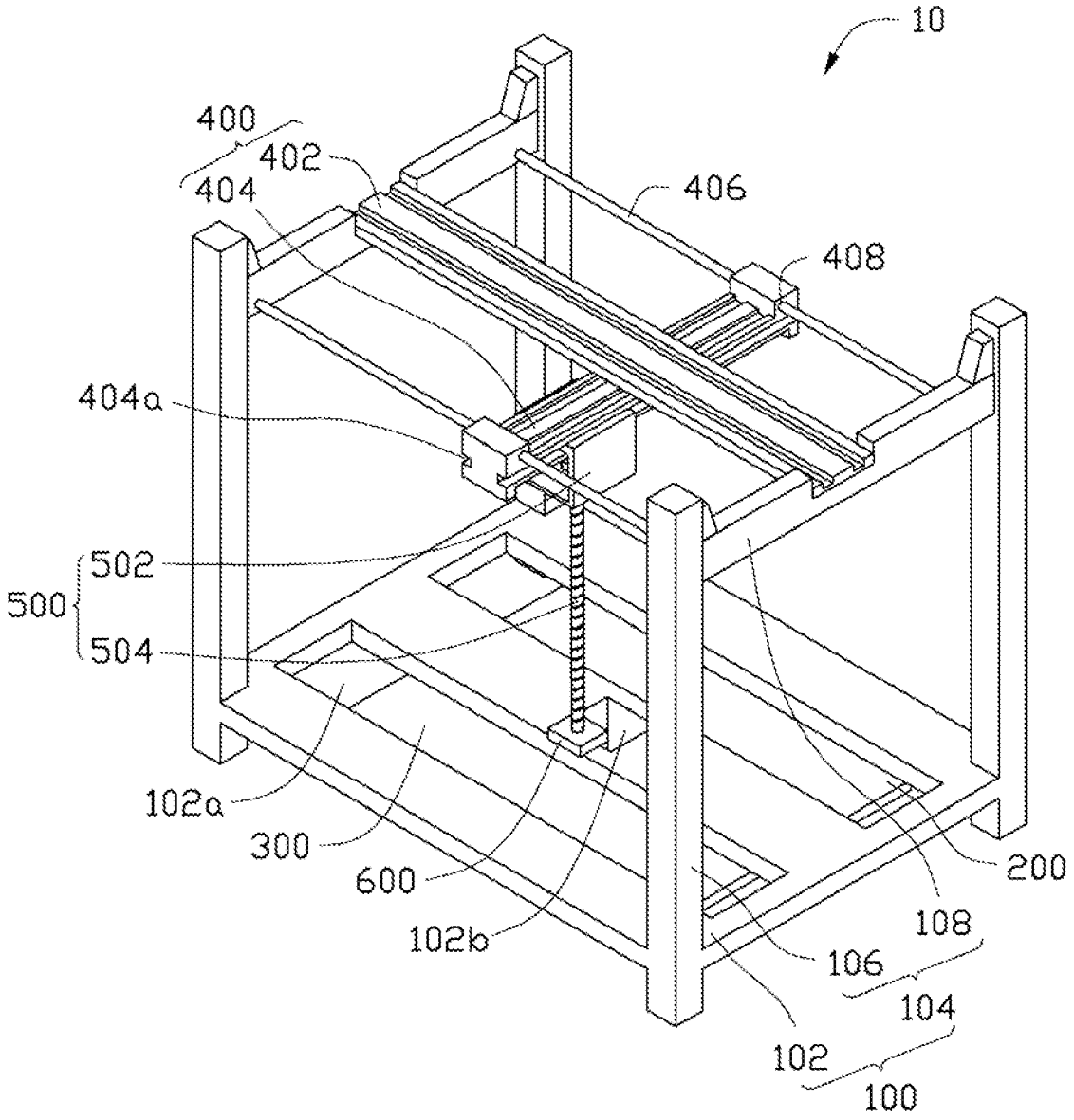
FIG. 1 is a perspective view of an assembled automatic wax removing device according to an exemplary embodiment.
Figure 2:
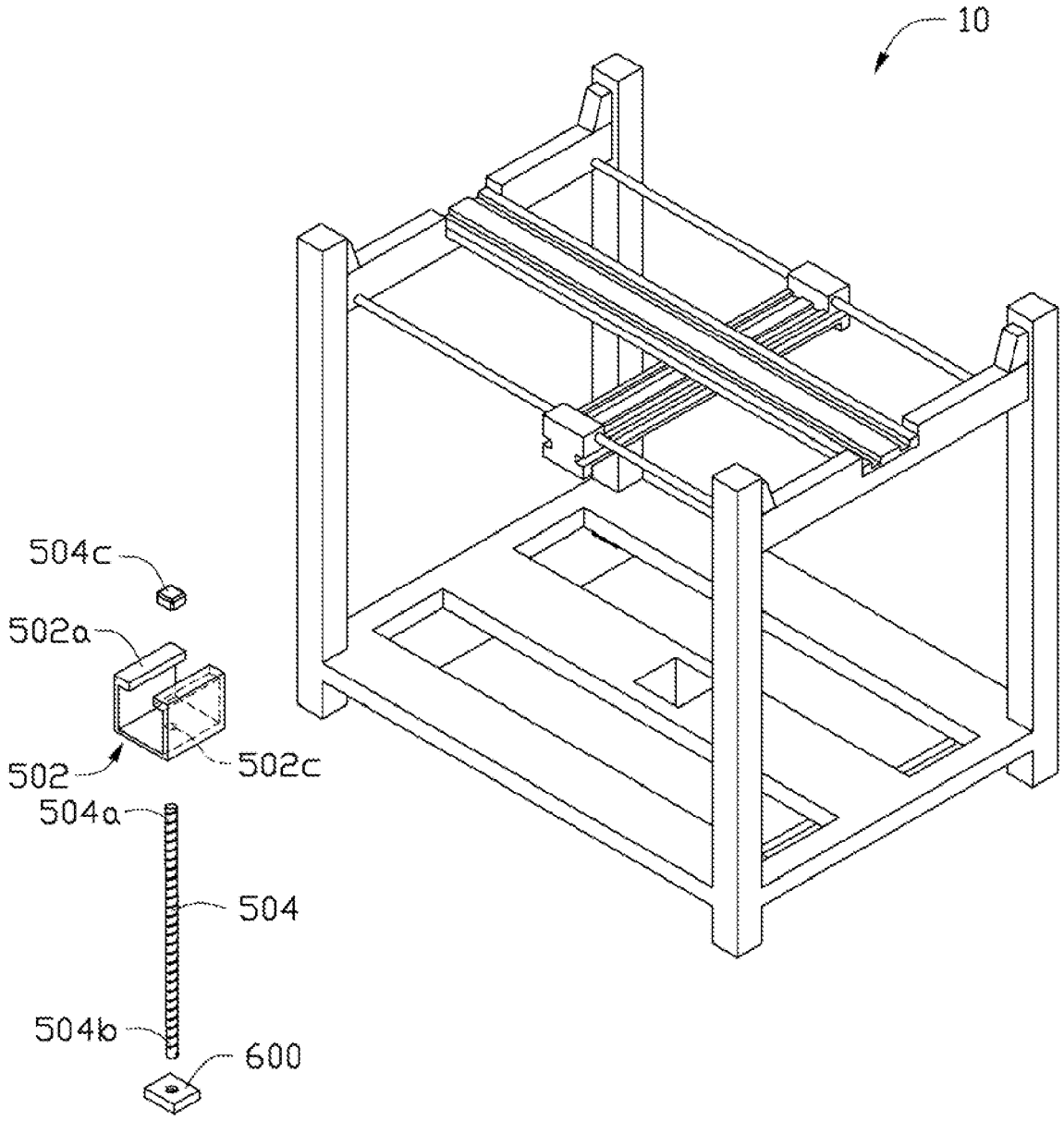
FIG. 2 is a partially disassembled perspective view of the automatic wax removing device of FIG. 1.

FIG. 1 shows an automatic wax removing device 10 in accordance with an exemplary embodiment. The automatic wax removing device 10 includes a base 100, a heating plate 200, a cooling plate 300, a first actuator 400, a second actuator 500, and an operation plate 600.

The base 100 includes a base plate 102 and a framework 104 arranged on the base plate 102.

The base plate 102 is a substantially rectangular plate. Two openings 102*a* are separately defined in the base plate 102, and extend almost the lengthwise direction of the base plate 102. One opening 102*a* receives the heating plate 200 and the other opening 102*a* receives the cooling plate 300. A wax storage tank 102*b* is defined in the base plate 102 for storing molten wax. In the present embodiment, the wax storage tank 102*b* is located between the two openings 102*a*.

The framework 104 includes four support posts 106 and two beams 108. Each of the four support posts 106 rises vertically from a corner of the base plate 102, and each pair of support posts 106 supports a corresponding beam 108. Each beam 108 is parallel with the width of the base plate 102.

The heating plate 200 is a substantially rectangular plate, and is received in one opening 102*a*. The heating plate 200 is metallic, and can be heated by an electric heating method. In the present embodiment, the heating plate 200 is parallel with the base plate 102.

The cooling plate 300 is a substantially rectangular plate, and is received in the other opening 102*a*. The cooling plate 300 is metallic, and can be cooled by a water circulation cooling device (not shown). In the present embodiment, temperature of the cooling plate 300 is kept in a range from 8-10 degrees Celsius, and the cooling plate 300 is also parallel with the base plate 102.

The first actuator 400 is a linear motor, and includes a sliding rail 402 and an elongated sliding member 404 arranged on the sliding rail 402.

The sliding rail 402 is fixed on the framework 104, and the sliding rail 402 is parallel with the base plate 102. In detail, the two ends of the sliding rail 402 are fixed at the centers of the two beams 108, and the lengthwise direction of the sliding rail 402 is parallel with the lengthwise direction of the base plate 102.

The sliding member 404 is perpendicular to the sliding rail 402. A guiding hole 408 is defined in each end of the sliding member 404, and extends along the sliding rail 402. Two symmetrical and lateral guiding grooves 404*a* are defined back-to-back in the sliding member 404 along the length of the sliding member 404. In the present embodiment, the guiding grooves 404*a* are U-shaped in section. In other embodiments, the guiding grooves 404*a* may be V-shaped or trapezoidal in section, for example.

The first actuator 400 also includes two guiding rails 406. The two guiding rails 406 are parallel with the sliding rail 40, and are located at either side of the sliding rail 402. One guiding rail 406 passes through a guiding hole 408, and the opposite ends of one guiding rail 406 are fixed to the corresponding beams 108. The other guiding rail 406 passes through the other guiding hole 408, and the opposite ends of the other guiding rail 406 are fixed to the corresponding beams 108.

The second actuator 500 includes a main body 502 and a rotary shaft 504 arranged on the main body 502. The main body 502 is substantially square, and resembles the letter "U" in section, with an inward-facing flange 502*a* at the top end of the arms of the "U". The two inward-facing flanges 502*a* are slidably received in the sliding grooves 404*a*, such that the main body 502 can slide along the lengthwise direction of the sliding member 404. A screw hole 502*c* is defined in the bottom of the main body 502 which faces the inward-facing flange 502*a*.

The rotary shaft 504 is a threaded rod, and includes a first end 504*a* and a second end 504*b*. The first end 504*a* passes through the screw hole 502*c*, and is fixed to a stopping block 504*c*. The stopping block 504*c* is configured for holding part of the rotary shaft 504 in the main body 502 while allowing the held part of the shaft 504 to rotate in the main body 502. In the present embodiment, the stopping block 504*c* is a substantially square block, and the stopping block 504*c* rests over the screw hole 502*c*. In alternative embodiments, the stopping block 504*c* may be triangular, pentagonal or round. The second end 504*b* is fixed to the operation plate 600.

The operation plate 600 is fixed to the second end 504*c* for picking up a lens stack 20 including a plurality of lenses 22 adhering to each other with wax. In the present embodiment, the operation plate 600 is parallel with the heating plate 200. In other embodiments, the operation plate 600 may be inclined relative to the heating plate 200.

Figure 3:
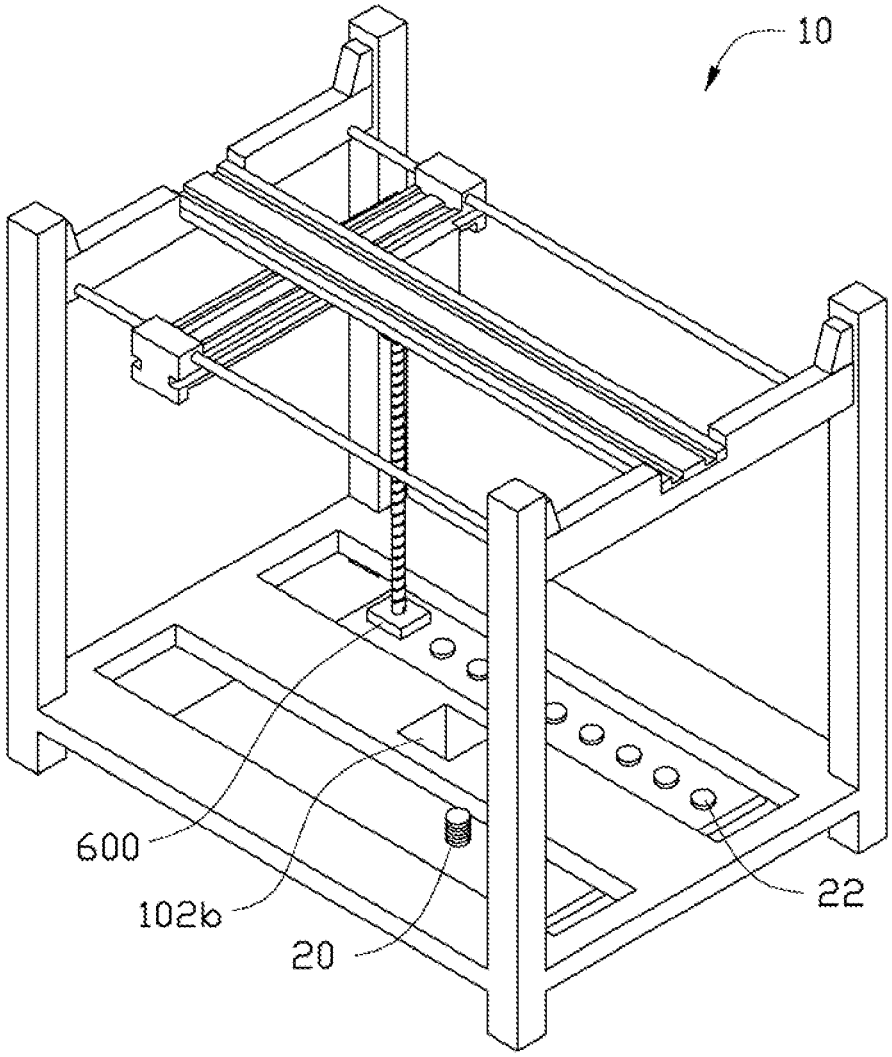
FIG. 3 is a perspective view of the automatic wax removing device of FIG. 1 in a wax removing process.

Referring to FIG. 3, in the process of using the automatic wax removing device 10, first, the heating plate 200 is heated, and the temperature of the cooling plate 300 is kept in a range from 8 centigrade degrees to 10 centigrade degrees. Second, the first actuator 400 is actuated, such that the sliding member 404 slides along the sliding rail 402 until the sliding member 404 is immediately above the wax storage tank 102*b*. Third, the second actuator 500 is actuated, such that the main body 502 slides along the sliding member 404 until the operation plate 600 is immediately above the wax storage tank 102*b*. Fourth, the rotation shaft 504 is rotated to drop the operation plate 600 into the wax storage tank 102*b*, thereby dipping the operation plate 600 in the molten wax in the wax storage tank 102*b*. Five, the operation plate 600 is moved to the lens stack 20 under the control of the first actuator 400 and the second actuator 500 and allowed to contact with the lens stack 20 until an end surface of the lens stack 20 adheres to the operation plate 600. Six, the operation plate 600 with the lens stack 20 is moved towards the heating plate 200 under the control of the first actuator 400 and the second actuator 500, and the lens stack 20 contacts the heating plate 200, so as to melt the wax on the lens stack 20, thereby enabling the lowest lens 22 of the lens stack 20 to be detached from the lens stack 20. Seven, the step of six is repeated, such that the lenses 22 of the lens stack 20 are separated one by one and placed on the heating plate 200 along the lengthwise direction of the heating plate 200, thereby the wax removing process is accomplished. In other words, when the operation plate 600 is moved along the lengthwise direction of the heating plate 200, the lenses 22 are impressed against the heating plate 200 one by one and along the direction of movement of the operation plate 600.

If molten wax is positioned on the operation plate 600 in advance, the wax storage tank 102*b* can be omitted.

The lenses 22 separated from each other can be collected by a lens supporter (not shown) by a robot arm (not shown). The number of manual workers of the automatic wax removing process can thus be reduced. In addition, in the automatic wax removing process, the automatic wax removing device 10 can be sealed off in its own enclosure, any harmful gas released in the wax removing process can thus not harm the health of any worker.

Figure 4:
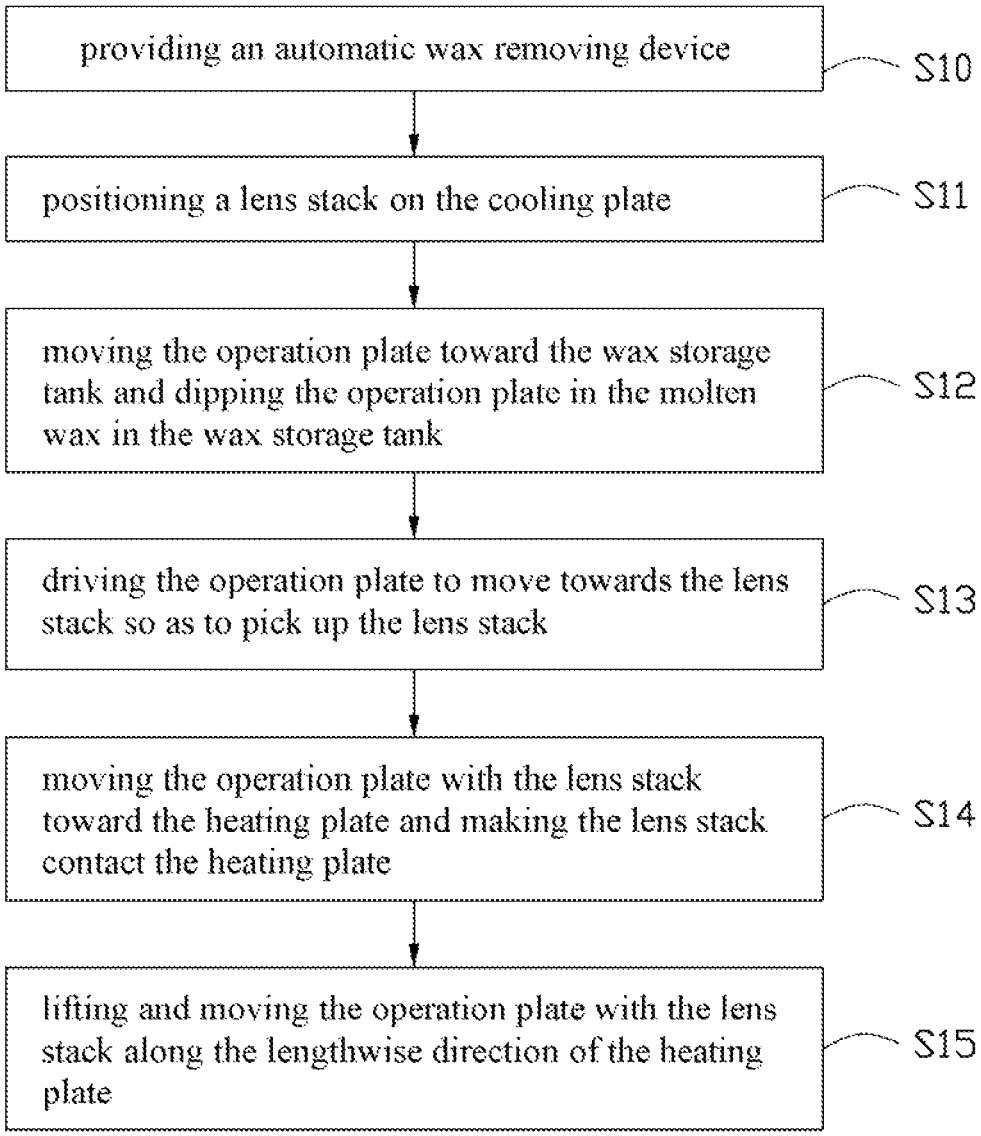
FIG. 4 is a flow chart of a wax removing method.

Referring to FIG. 4, an automatic waxing removing method by using the automatic wax removing device 10 includes the following steps.

In step S10, the automatic wax removing device 10 is provided.

In step S11, the lens stack 20 is positioned on the cooling plate 300. In this step, the heating plate 200 is heated in advance, and the temperature of the cooling plate 300 is kept in a range from 8-10 degrees Celsius. The lens stack 20 includes a plurality of lenses 22 adhered to each other with wax.

In step S12, the operation plate 600 is driven by the first actuator 400 and the second actuator 500 to move towards the wax storage tank 102*b* and to be dipped in the molten wax in the wax storage tank 102*b*.

In step S13, the operation plate 600 covered with the molten wax is driven by the first actuator 400 and the second actuator 500 to move towards the lens stack 20 so as to pick up the lens stack 20.

In step 14, the operation plate 600 with the lens stack 20 is driven by the first actuator 400 and the second actuator 500 to move toward the heating plate 200, and the lens stack 20 is made to contact the heating plate 200 with the central axis of the lens stack 20 perpendicular to the heating plate 200, so as to melt the wax on the lens stack 20, thereby enabling the lowest lens 22 of the lens stack 20 to be detached from the lens stack 20.

In step 15, the operation plate 600 with lens stack 20 is lifted and moved along the lengthwise direction of the heating plate 200, so as to leave the detached lens 22 on the heating plate 200

The above steps S14~S15 can be repeated, such that the lenses 22 of the lens stack 20 are separated one by one and placed on the heating plate 200 along the lengthwise direction of the heating plate 200.

In other embodiments, if molten wax is positioned on the operation plate 600 in advance, step S12 can be omitted.

The individually separated lenses can be removed from the heating plate 200, and collected to the lens supporter by the robot arm. The number of manual workers of the wax removing process can thus be reduced.

While certain embodiments have been described and exemplified above, various other embodiments will be apparent from the foregoing disclosure to those skilled in the art. The disclosure is not limited to the particular embodiments described and exemplified but is capable of considerable variation and modification without departure from the scope and spirit of the appended claims.

What is claimed is:

1. An automatic wax removing device, comprising:

a base, the base comprising a base plate and a framework arranged on the base plate;

a heating plate arranged on the base plate;

a cooling plate arranged on the base plate and separated from the heating plate;

a first actuator, the first actuator comprising a sliding rail and an elongated sliding member, the sliding rail being fixed on the framework and parallel with the heating plate, and the sliding member being perpendicular to the sliding rail;

a second actuator, the second actuator comprising a main body and a rotation shaft arranged on the main body, the main body being slideable along the lengthwise direction of the elongated sliding member, and one end of the rotation shaft being threadedly engaged with the main body; and an operation plate, the operation plate being fixed to the other end of the rotation shaft.

2. The automatic wax removing device of claim 1, wherein the elongated sliding member defines two symmetrical and lateral guiding grooves back to back along the length of the elongated sliding member, the main body is substantially square, and resembles the letter "U" in section, with an inward-facing flange at the top end of the arms of the "U", two inward-facing flanges are slidably received in one the two symmetrical and lateral guiding grooves, such that the main body is slidable along the length of the elongated sliding member.

3. The automatic wax removing device of claim 2, wherein the bottom of the main body defines a screw hole, the rotation shaft is a screw rod, the rotation shaft comprises a first end and a second end opposite to the first end, the first end passes through the screw hole and threadedly engages with the main body, and the second end is fixed to the operation plate.

4. The automatic wax removing device of claim 3, wherein a stopped block is fixed to the first end for holding part of the rotary shaft in the main body while allowing the held part of the shaft to rotate in the main body.

5. The automatic wax removing device of claim 4, wherein the stopping block is a substantially square block, and the diameter of the circumscribed circle of the stopping block is larger than the diameter of the screw hole.

6. The automatic wax removing device of claim 1, wherein the base plate is a substantially rectangular plate, and defines two openings separated from each other, the heating plate is a substantially rectangular plate, and is received in one opening, and the cooling plate is a substantially rectangular plate and is received in the other opening.

7. The automatic wax removing device of claim 1, wherein the framework comprises four support posts and two beams, each of the four support posts rises vertically from a corner of the base plate, each pair of support posts supports the corresponding beam, and each beam is parallel with the width of the base plate.

8. The automatic wax removing device of claim 7, wherein the two ends of the sliding rail are fixed to the two beams, and the length of the sliding rail is parallel with the length of the base plate.

9. The automatic wax removing device of claim 7, wherein the elongated sliding member further defines a guiding hole in each end thereof, the first actuator further comprises two guiding rails, the guiding rails are located at either side of the sliding rail, one guiding rail pass through one guiding hole, and the opposite ends of one guiding rail are fixed to the corresponding beams, the other guiding rail passes through the other guiding hole, and the opposite ends of the other guiding rail are fixed to the corresponding beams.

10. The automatic wax removing device of claim 1, wherein the heating plate is made of metallic material.

11. The automatic wax removing device of claim 1, wherein the base plate further comprises a wax storage tank for storing molten wax, the first actuator is configured for moving and dipping the operation plate in the storing molten wax in the wax storage tank.

* * * * *